US006895914B2

(12) United States Patent
Rado et al.

(10) Patent No.: US 6,895,914 B2
(45) **Date of Patent: *May 24, 2005**

(54) AUTOMATIC ENGINE PRIMING SYSTEM FOR ROTARY MOWERS

(75) Inventors: Gordon E. Rado, Plymouth, WI (US); John F. Hoffman, Fort Wayne, IN (US); Adam F. Cox, Fort Wayne, IN (US)

(73) Assignee: Tecumseh Products Company, Tecumseh, MI (US)

( * ) Notice: Subject to any disclaimer, the term of this patent is extended or adjusted under 35 U.S.C. 154(b) by 37 days.

This patent is subject to a terminal disclaimer.

(21) Appl. No.: 10/442,604

(22) Filed: May 21, 2003

(65) Prior Publication Data

US 2004/0084786 A1 May 6, 2004

Related U.S. Application Data

(63) Continuation-in-part of application No. 10/287,105, filed on Nov. 4, 2002, now Pat. No. 6,779,503.

(51) Int. Cl.[7] ..... F02M 1/10

(52) U.S. Cl. ..... 123/179.11; 123/179.13; 261/36.2; 261/DIG. 8

(58) Field of Search ..... 123/179.11, 179.13; 261/36.2, DIG. 8

(56) References Cited

U.S. PATENT DOCUMENTS

| | | | | |
|---|---|---|---|---|
| 1,544,306 A | | 6/1925 | Franzen | |
| 2,063,087 A | | 12/1936 | Fitz Gerald | 123/119 |
| 2,293,792 A | | 8/1942 | Ball | 261/34 |
| 2,793,634 A | | 5/1957 | Ericson | 123/179 |
| 2,949,102 A | | 8/1960 | Arkus-Duntov | 123/119 |
| 3,246,886 A | | 4/1966 | Goodyear et al. | 261/39 |
| 3,587,553 A | | 6/1971 | Sutton | 123/180 E |
| 3,620,202 A | | 11/1971 | Ross | 123/179 G |
| 3,695,591 A | | 10/1972 | Caisley | 261/39 D |
| 3,872,851 A | | 3/1975 | Matsumoto et al. | 123/180 R |
| 4,194,483 A | | 3/1980 | McChesney et al. | 123/187.5 R |
| 4,311,129 A | | 1/1982 | Kakizaki et al. | 123/588 |
| 4,455,811 A | | 6/1984 | Beugelsdyk | 56/10.8 |
| 4,803,963 A | | 2/1989 | Kleinhans | 123/187.5 R |
| 4,814,114 A | | 3/1989 | Charmley | 261/35 |
| 4,905,641 A | * | 3/1990 | Miller | 123/179.13 |
| 5,355,662 A | | 10/1994 | Schmidt | 56/11.3 |
| 5,701,967 A | | 12/1997 | Barnard | 180/19.3 |
| 5,750,056 A | | 5/1998 | Pitman et al. | 261/37 |
| 5,803,035 A | | 9/1998 | Guntly | 123/179.11 |
| 6,029,619 A | | 2/2000 | Mitchell | 123/179.11 |
| 6,152,431 A | | 11/2000 | Stenz et al. | 261/34.1 |
| 6,557,833 B1 | | 5/2003 | Roth | 261/34.1 |
| 6,779,503 B2 | * | 8/2004 | Rado | 123/179.11 |

* cited by examiner

*Primary Examiner*—Andrew M. Dolinar
(74) *Attorney, Agent, or Firm*—Baker & Daniels

(57) ABSTRACT

A priming system for the carburetor of a small internal combustion engine which is used with a lawnmower, for example, in which the priming system is remotely actuated. The priming system includes a priming feature for supplying an amount of liquid fuel to the carburetor throat to aid in starting the engine, and an enrichment feature for providing an enriched fuel supply to the engine during a warm-up period. In one embodiment, the priming system includes an automatic primer disabling feature which is operative when the engine is warm to block the supply of priming fuel to the carburetor throat and thereby prevent priming during a warm engine re-start. In another embodiment, the priming system includes a primer reduction feature, which is operative when the engine is warm to provide a reduced amount of priming fuel to the carburetor throat during a warm engine re-start, with respect to the amount of fuel which is supplied during a cold engine start.

26 Claims, 5 Drawing Sheets

AUTOMATIC ENGINE PRIMING SYSTEM FOR ROTARY MOWERS

CROSS REFERENCE TO RELATED APPLICATIONS

This application is continuation-in-part of U.S. patent application Ser. No. 10/287,105, entitled AUTOMATIC PRIMING SYSTEM FOR ROTARY MOWERS, filed on Nov. 4, 2002, now U.S. Pat. No. 6,779,503.

BACKGROUND OF THE INVENTION

1. Field of the Invention

The present invention relates to small internal combustion engines of the type used for lawn mowers, lawn and garden tractors, snow throwers and other implements, or small sport vehicles. Particularly, the present invention relates to a priming system to aid in starting such engines.

2. Description of the Related Art

Small internal combustion engines typically include a carburetor which mixes liquid fuel with atmospheric air drawn through the carburetor to provide an air/fuel combustion mixture to the engine. One type of carburetor commonly used in small engines includes a throat with a venturi through which air is drawn, and into which fuel is drawn for mixing with the intake air. A fuel bowl is disposed beneath the throat in which a quantity of liquid fuel is contained. A float valve in the fuel bowl meters the supply of fuel into the fuel bowl from the main fuel tank as necessary as the fuel in the fuel bowl is consumed.

Additionally, such carburetors typically include a manually operable priming feature, such as a flexible priming bulb which is depressed by an operator to pressurize the air space above the fuel in the fuel bowl, thereby forcing a quantity of priming fuel into the carburetor throat for mixing with the intake air which is drawn into the carburetor. The priming fuel is in excess of the amount of fuel which is normally supplied for mixing with the intake air to form a combustion mixture, such that a rich air/fuel mixture is initially supplied to the engine to aid in engine starting. After the engine starts, the priming fuel is consumed, and mixing of the air/fuel mixture is thereafter controlled by the fuel metering system of the carburetor during running of the engine.

The foregoing priming feature for carburetors requires an operator to manually press the flexible priming bulb at the location of the carburetor in order to prime the engine. Although remote priming devices which utilize a cable operably connected between the handle of an implement and the flexible priming bulb of the carburetor have been devised, such devices typically require multiple actuations thereof by an operator in order to build sufficient air pressure within the carburetor bowl to properly pressurize same.

Additionally, repeated actuation of such priming mechanisms when the engine is already in a warm condition, such as during warm engine re-starts, may provide an unnecessarily rich fuel/air mixture to the engine which could flood the engine.

It is desirable to provide a priming system for use with carburetors of small internal combustion engines which is an improvement over the foregoing.

SUMMARY OF THE INVENTION

The present invention provides a priming system for the carburetor of a small internal combustion engine which is used with a lawnmower, for example, in which the priming system is remotely actuated. The priming system includes a priming feature for supplying an amount of liquid fuel to the carburetor throat to aid in starting the engine, and an enrichment feature for providing an enriched fuel supply to the engine during a warm-up period. In one embodiment, the priming system includes an automatic primer disabling feature which is operative when the engine is warm to block the supply of priming fuel to the carburetor throat and thereby prevent priming during a warm engine re-start. In another embodiment, the priming system includes a primer reduction feature, which is operative when the engine is warm to provide a reduced amount of priming fuel to the carburetor throat during a warm engine re-start, with respect to the amount of fuel which is supplied during a cold engine start.

A bail assembly on the implement with which the engine is used is connected via cable linkage to a rotatable cam member of the carburetor. When the bail is actuated prior to starting the engine, translation of the cable rotates the cam member to engage a cam surface thereof with a plunger of the carburetor to depress the plunger. Depression of the plunger forces a quantity of fuel from a priming chamber, defined between the plunger and the carburetor body, into the throat of the carburetor to provide a rich fuel/air mixture for engine priming.

After an initial quantity of fuel is forced from the priming chamber into the throat of the carburetor, a further quantity of fuel remains within the priming chamber and is gradually drawn into the throat of the carburetor during an initial running period of the engine to provide an enriched air/fuel mixture to the engine until the priming chamber is empty of liquid fuel. In this manner, the present priming system provides an initial amount of fuel for engine starting, and also provides an extended priming feature.

Additionally, the present priming system includes a thermally-responsive element operable during warm engine temperatures to either disable the priming function or to reduce the amount of priming fuel which is supplied. Specifically, a disk is rotatably mounted to the carburetor body within the priming chamber, and a thermally responsive element, such a bimetallic spring, is connected between the disk and the carburetor body.

In a priming system in accordance with a first embodiment, the bimetallic spring positions the disk in a first position when the engine is cold, wherein an opening in the disk is aligned with the priming passage connecting the priming chamber to the throat of the carburetor, such that liquid fuel may be forced therethrough for priming. Additionally, in the first disk position, a flap valve portion of the disk is aligned with a fuel supply passage which connects the fuel bowl to the priming chamber, and acts as a check valve such that when the plunger is depressed, fuel may only be forced through the priming passage to the throat of the carburetor.

When the engine reaches a warm operating temperature, the bimetallic spring rotates the disk to a second position in which the aperture thereof is not aligned with the priming passage and the supply of priming fuel from the priming chamber through the priming passage to the throat of the carburetor is blocked to thereby disable the priming function. Also, in the second disk position, the flap valve portion of the disk is not aligned with the fuel supply passage, such that fuel may pass from the priming chamber to the fuel bowl.

In a priming system in accordance with a second embodiment, the priming passage is always in communication with the carburetor throat regardless of the rotational position of the disk, such that an amount of liquid fuel is forced therethrough for priming responsive to each actuation of the plunger. The bimetallic spring positions the disk in a first position when the engine is cold, in which a portion of the disk blocks a vent passage which connects the priming chamber to the fuel bowl. A check valve prevents passage of fuel from the priming chamber to the fuel bowl through the fuel supply passage. Thus, because the fuel supply passage and the vent passage are both blocked during a cold start priming operation, a maximum amount of priming fuel is supplied to the carburetor throat.

When the engine reaches a warm operating temperature, the bimetallic spring rotates the disk to a second position in which a set of vent holes in the disk are moved into alignment with the vent passage. If the priming mechanism is actuated in the second disk position, a reduced amount of priming fuel is supplied to the throat of the carburetor for priming, because air in the priming chamber is vented into the fuel bowl through the vent passage and thence to the throat of the carburetor through the carburetor's internal vent.

The bimetallic spring is adjustably connected to the disk in order to vary the point of connection therebetween. In this manner, the disablement or the reduction of the priming function can be properly correlated to an engine temperature at which its is desired to either disable or to reduce the priming function.

Advantageously, the present invention provides a remotely-actuated priming system, eliminating the need for an operator to prime the carburetor at the location of the carburetor. Further, the thermally-responsive element is actuated at warm engine temperatures to disable or to reduce the priming function, such that flooding of the engine during warm re-starts is less likely.

In one form thereof, the present invention provides a carburetor, including a carburetor body having a throat; a movable primer element connected to the carburetor, the primer element and the carburetor defining a variable-volume priming chamber therebetween in which a quantity of liquid fuel is disposed, the priming chamber in fluid communication with the throat and further including a vent; and a thermally-responsive element disposed between the priming chamber and the vent, the thermally-responsive element moveable between a first position corresponding to cold temperatures in which the thermally-responsive element substantially blocks the vent, and a second position corresponding to warm temperatures in which the thermally-responsive element does not block the vent; whereby when the thermally-responsive element is in the first position, movement of the primer element forces a first amount of the liquid fuel from the priming chamber into the throat, and when the thermally-responsive element is in the second position, movement of the primer element forces a reduced amount of the liquid fuel from the priming chamber into the throat.

In another form thereof, the present invention provides a carburetor, including a carburetor body having a throat; a movable primer element connected to the carburetor body and defining a variable volume priming chamber therebetween in which a quantity of liquid fuel is disposed, the priming chamber in fluid communication with the throat; and thermally-responsive means disposed within the priming chamber for reducing the amount of the liquid fuel which is forced from the priming chamber into the throat upon movement of the primer element as the temperature within the priming chamber increases.

In a further form thereof, the present invention provides an internal combustion engine, including an engine housing; a carburetor attached to the engine housing, the carburetor having a throat; a movable primer element connected to the carburetor, the primer element and the carburetor defining a variable-volume priming chamber therebetween in which a quantity of liquid fuel is disposed, the priming chamber in fluid communication with the throat and further including a vent; and a thermally-responsive element disposed between the priming chamber and the vent, the thermally-responsive element moveable between a first position corresponding to cold engine temperatures in which the thermally-responsive element blocks the vent, and a second position corresponding to warm engine temperatures in which the thermally-responsive element does not block the vent; whereby when the thermally-responsive element is in the first position, movement of the primer element forces a first amount of the liquid fuel from the priming chamber into the throat, and when the thermally-responsive element is in the second position, movement of the primer element forces a reduced amount of the liquid fuel from the priming chamber into the throat.

In a further form thereof, the present invention provides a carburetor, including a carburetor body having a throat; a primer element moveably connected to the carburetor, the primer element and the carburetor defining a variable-volume priming chamber therebetween in fluid communication with the throat, in which a quantity of liquid fuel is disposed; a primer quantity regulating element movable between a full prime position corresponding to cold engine temperatures and a reduced or no prime position corresponding to warm engine temperatures; the regulating element driven by a thermally-responsive element connected to the regulating element, the thermally-responsive element responsive to engine temperature changes, the thermally-responsive element adjustably connected to the primer regulating element, whereby movement characteristics of the primer regulating element may be varied.

In a still further form thereof, the present invention provides a method of operating an internal combustion engine having a carburetor, including the steps of: depressing a primer element to reduce the volume of a priming chamber in which a quantity of liquid fuel is disposed; forcing at least a portion of the liquid fuel from the priming chamber into a throat of the carburetor to prime the carburetor; starting the engine; and automatically opening a vent in the priming chamber when the engine reaches a warm operating temperature, whereby a reduced portion of liquid fuel is forced from the priming chamber into the throat of the carburetor upon any subsequent depression of the primer element.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention any manner.

DETAILED DESCRIPTION

Figure 1:
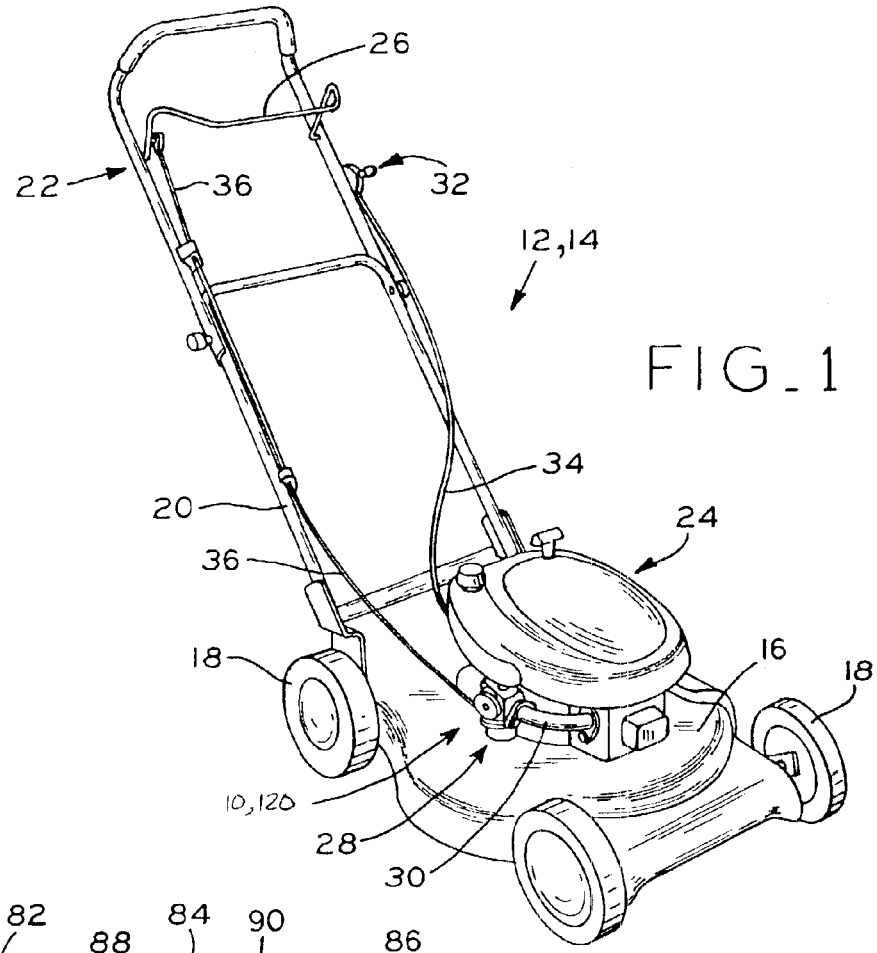
FIG. 1 is a perspective view of an exemplary implement, shown as a lawnmower having an internal combustion engine, and a carburetor incorporating the priming system of the present invention.

Referring to FIG. 1, automatic priming systems 10, 120 of the present invention are shown in connection with the engine of implement 12. Implement 12 is shown as a lawnmower 14; however, automatic priming systems 10, 120 may be used with small internal combustion engines of various other implements, such as snow throwers and tillers, for example. Lawnmower 14 generally includes deck 16 having wheels 18, handle 20 operably attached to deck 16, and bail assembly 22 mounted to handle 20. Additionally, lawnmower 14 includes internal combustion engine 24 mounted to deck 16, wherein the power take-off ("PTO") end of the engine crankshaft (not shown) is disposed vertically, and extends beneath deck 16 for driving connection to a blade (not shown). Engine 24 may be of any suitable type, such as an overhead valve ("OHV") engine, an overhead cam ("OHC") engine, or a side valve ("L-head") engine, for example, and engine 24 may also be either a horizontal crankshaft engine or a vertical crankshaft engine.

Bail assembly 22 includes bail 26, which may be operatively attached to the ignition system of the engine via suitable linkage (not shown), such that bail 26 must be actuated by an operator in order to start the engine, and wherein release of bail 26 during engine running interrupts the engine ignition resulting in engine shut-down. Additionally, release of bail 26 may also actuate an engine braking mechanism to stop the rotation of the blade of lawnmower 14 upon engine shut-down.

Engine 24 includes carburetor 28 for supplying an air/fuel mixture to the intake port of engine 24 via intake manifold 30. Throttle control 32 is operably attached to carburetor 28 via cable 34 to provide an operator-controlled speed input to carburetor 28. Bail 26 of bail assembly 22 is also attached to carburetor 28 via cable 36, wherein actuation of bail 26 in turn actuates priming system 10, as explained further below.

Figure 2:
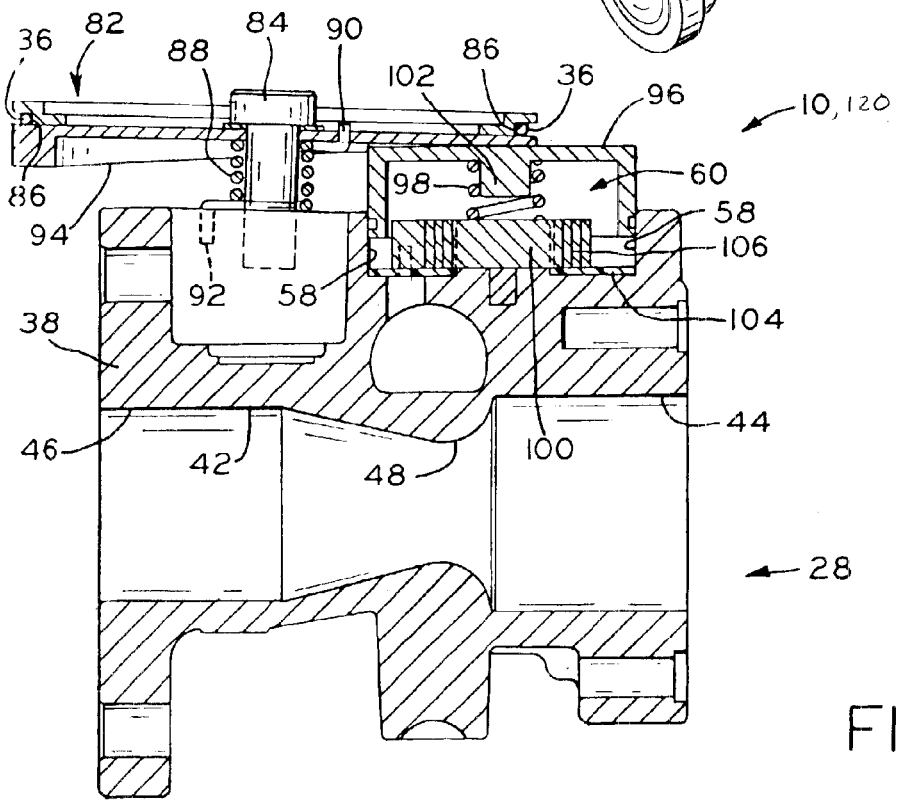
FIG. 2 is a horizontal sectional view through a portion of the body of the carburetor which is attached to the engine of the implement of FIG. 1.
Figure 5:
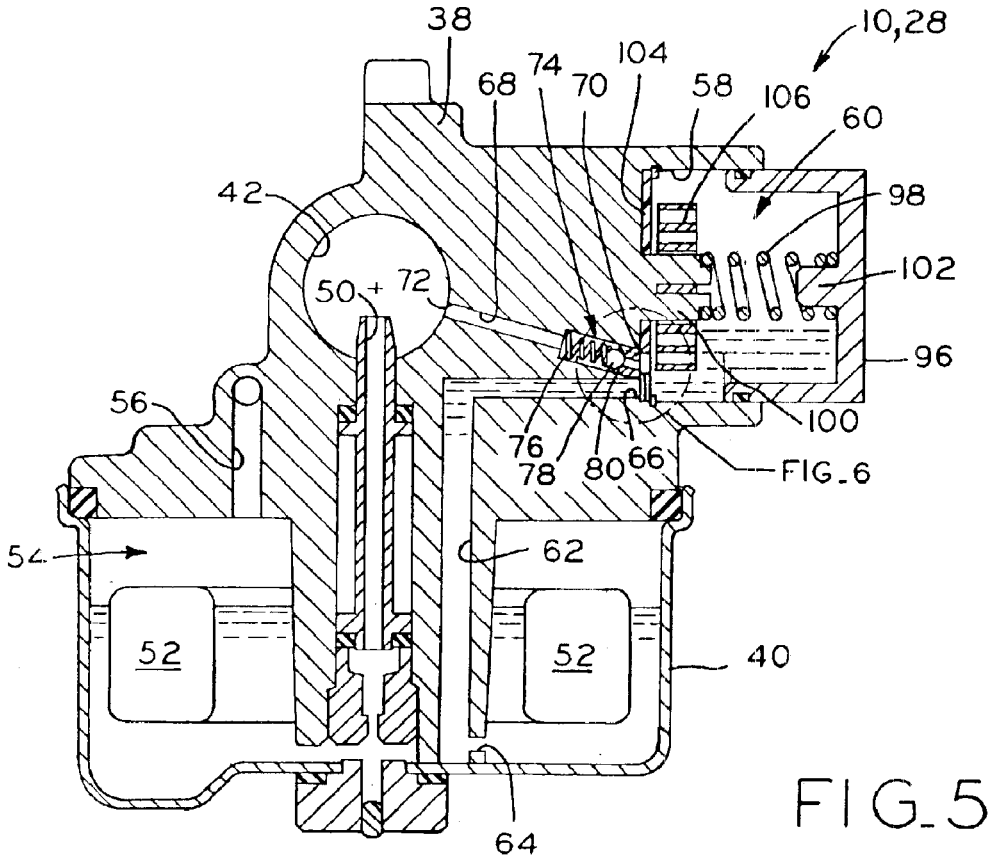
FIG. 5 is a vertical sectional view through the body of the carburetor of FIGS. 3 and 4, showing the disk in a first rotational position.

Referring to FIGS. 2 and 5, carburetor 28 generally includes carburetor body 38 and fuel bowl 40 attached to carburetor body 38. Carburetor 28 includes many features similar to the carburetor disclosed in U.S. Pat. No. 6,152,431, assigned to the assignee of the present invention, the disclosure of which is expressly incorporated herein by reference. Carburetor body 38 includes throat 42 disposed therethrough, which includes inlet end 44 and outlet end 46 and venturi portion 48 defined therebetween. Referring to FIG. 5, main fuel jet 50 extends from fuel bowl 40 into throat 42 to supply fuel into throat 42 in response to vacuum created at venturi portion 48 of throat 42 during running of engine 24. Fuel bowl 40 includes a quantity of fuel therein, and also includes float 52 which floats on the fuel within fuel bowl 40 and periodically actuates a valve (not shown) for metering a supply of fuel into fuel bowl 40 from a separate fuel tank (not shown). Air space 54 is defined within fuel bowl 40 above the fuel therewithin, and is vented to the atmosphere via internal vent passage 56, which is connected to inlet end 44 of throat 42.

Carburetor body 38 additionally includes annular recess 58 which forms a portion of priming chamber 60, as described further below. Referring to FIG. 5, fuel supply passage 62 connects fuel bowl 40 to priming chamber 60, and includes inlet 64 disposed beneath the level of fuel in fuel bowl 40, and outlet 66 opening into priming chamber 60. Priming chamber 60 is further connected to throat 42 via priming passage 68 having inlet 70 in communication with priming chamber 60, and outlet 72 opening into throat 42 of carburetor 28. Check valve 74 is disposed within priming passage 68, and generally includes spring 76, which biases ball 78 against seat 80 such that check valve is operable to allow passage of fuel from priming chamber 60 to throat 42 of carburetor 28, and to prevent passage of air or fuel from throat 42 to priming chamber 60.

Referring to FIG. 2, a primer actuator, such as cam member 82, is rotatably mounted to carburetor body 38 in a suitable manner, such as upon stub shaft 84 extending from carburetor body 38. Cam member 82 is shaped similar to a pulley, and includes annular groove 86 therearound for receiving cable 36, an end of which is attached to cam member 82. An opposite end of cable 36 is attached to bail 26, as shown in FIG. 1. Return spring 88, shown as a torsional spring in FIG. 2, includes a first end 90 connected to carburetor body 38 and second end 92 connected to cam member 82. Movement of bail 26 toward the upper end of handle 20 translates cable 36 to rotate cam member 82 upon stub shaft 84 against the bias of return spring 88. Cam member 82 further includes a sloped cam surface 94 proximate plunger 96.

Figure 3:
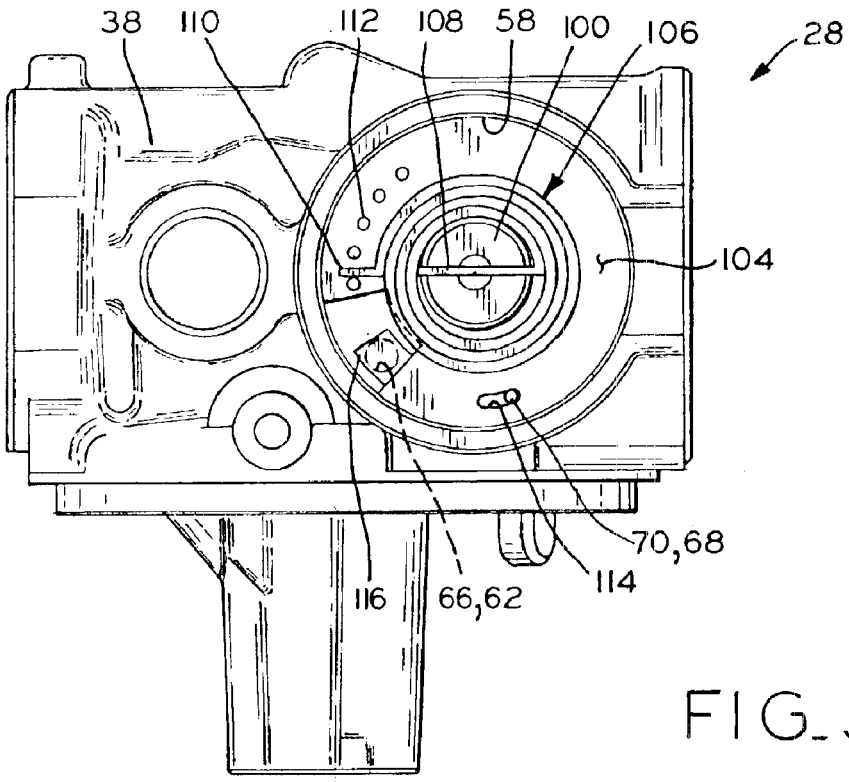
FIG. 3 is a first side elevational view of a portion of the carburetor, having a priming system according to a first embodiment, with the disk shown in a first rotational position corresponding to a cold engine temperature.

The automatic priming system includes a primer element such as plunger 96 slidably mounted with respect to annular recess 58 of carburetor body 38, and comprising a rigid cup-shaped member made from a suitable metal or plastic, for example. Plunger 96 and annular recess 58 together define priming chamber 60 therebetween. Referring to FIGS. 2 and 3, return spring 98 is captured under compression between a boss 100 projecting centrally within annular recess 58 of carburetor body 38 and stub 102 projecting from an interior surface of plunger 96. Referring to FIG. 2, rotation of cam member 82, as described above, rotates cam surface 94 thereof into engagement with plunger 96 to force plunger 96 inwardly toward carburetor body 38 against the bias of return spring 98 to reduce the volume of priming chamber 60, as described in further detail below. Although plunger 96 is shown herein in the form of a rigid, piston-type device, it could also be formed as a resilient bulb.

Figure 4:
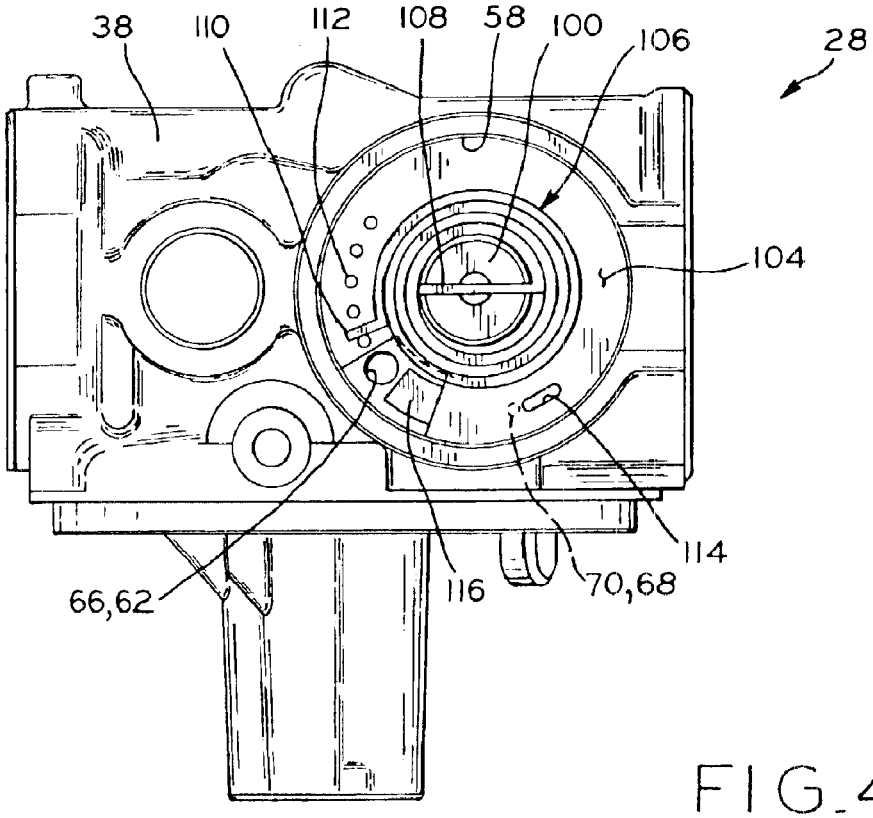
FIG. 4 is a second side elevational view of a portion of the carburetor of FIG. 4, showing the disk in a second rotational position corresponding to a warm engine temperature.

Referring to FIGS. 2–6, a thermally-responsive element, disposed within priming chamber 60, generally includes disk 104 and bimetallic spring 106. Disk 104 is best shown in FIGS. 3 and 4, and generally includes a flat annular plate made of a suitable metal or plastic, for example, which is rotatably mounted around boss 100 of carburetor body 38. As shown in FIGS. 3 and 4, bimetallic spring or coil 106 is formed in two layers from materials having differing coefficients of thermal expansion, such that bimetallic spring contracts or expands based upon changes in temperature. Bimetallic spring 106 is coiled about boss 100 of carburetor body 38, and includes first end 108 fixedly attached to boss 100, and second end 110 attached to disk 104 via engagement of second end 108 between a pair of adjacent adjustment pins 112 within a plurality same which extend from disk 104.

Disk 104 additionally includes slot 114 and valve element 116. In a first rotational position of disk 104 shown in FIGS. 3 and 5, slot 114 is aligned with inlet 70 of priming passage 68, and flexible valve element 116 is disposed above outlet 66 of fuel supply passage 62. In this position, valve element 116 may flex away from outlet 66 to allow passage of fuel from fuel supply passage 62 into priming chamber 60, but seats against outlet 66 to prevent passage of fuel from priming chamber 60 through fuel supply passage 62. In a second rotational position of disk 104 shown in FIGS. 4 and 6, slot 114 of disk 104 is not aligned with inlet 70 of priming passage 68 such that disk 104 blocks inlet 70 of priming passage 68, and valve element 116 of disk 104 is disposed out of alignment with outlet 66 of fuel supply passage 62 such that priming chamber 60 is in direct communication with fuel bowl 40 through fuel supply passage 62.

The operation of priming system 10 according to the first embodiment will now be explained. When engine 24 is in a cold condition before starting, an initial quantity of fuel is disposed within priming chamber 60, as shown in FIG. 5, and plunger 96 is biased to its outward position by return spring 98. Additionally, bimetallic spring 106 is also in a cold state, and positions disk 104 in the first rotational position shown in FIG. 3, in which slot 114 of disk 104 is aligned with inlet 70 of priming passage 68, and valve portion 116 of disk 104 covers outlet 66 of fuel supply passage 62.

Referring to FIGS. 1 and 2, an operator primes the engine by actuating bail assembly 24, in which the operator manually moves bail 26 toward the upper portion of handle 20, thereby translating cable 36 and rotating cam member 82. Rotation of cam member 82 against the bias of return spring 88 rotates cam surface 94 thereof into contact with plunger 96, forcing plunger 96 inwardly toward carburetor body 38 against the bias return spring 98. As plunger 96 is forced inwardly, the volume of priming chamber 60 is decreased, and a metered amount of fuel within priming chamber 60 is forced through slot 114 in disk 104 and through priming passage 68 and check valve 74 into throat 42 of carburetor 28, where the fuel is mixed with intake air drawn through throat 42 to form a rich air/fuel mixture to aid in starting engine 24. Concurrently, fuel within priming chamber 60 is prevented from exiting priming chamber 60 through fuel supply passage 62, which is covered by valve portion 116 of disk 104 seated against outlet 66 of fuel supply passage 62.

After engine 24 starts, the operator will usually maintain bail 26 in the actuated position such as, for example, if bail assembly 22 is operatively connected to the ignition system of engine 24. Therefore, cam member 82 will maintain plunger 96 in a depressed condition during running of engine 24. Further, after engine 24 is initially started, a quantity of fuel, which is not initially forced through priming passage 68 into throat 42, remains within priming chamber 60 and is prevented from exiting priming chamber 60 due to the positioning of valve portion 116 of disk 104 over outlet 66 of fuel supply passage 62. The vacuum within throat 42 of carburetor 28 gradually draws this remaining quantity of fuel within priming chamber 60 through priming passage 68 and check valve 74 into throat 42 until the amount of fuel within priming chamber 60 is exhausted, or until the priming function is terminated by rotation of disk 104, as described below. In this manner, priming chamber 60 not only supplies an initial amount of liquid fuel for engine priming upon starting of engine 24, but also supplies a further amount of priming fuel during an initial warm-up period after engine 24 starts for extended priming of engine 24.

Figure 6:
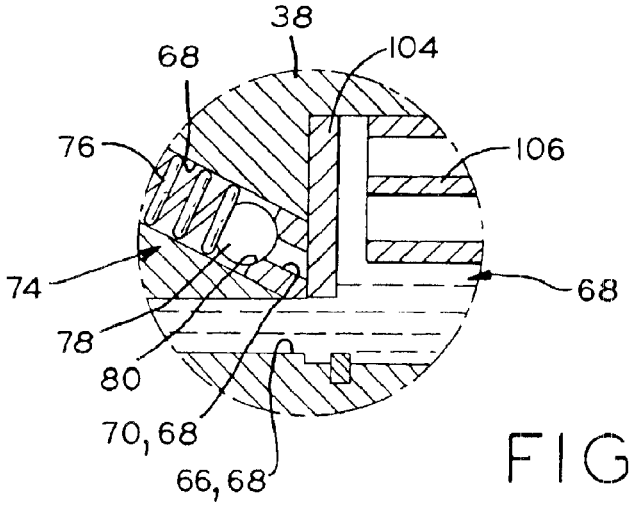
FIG. 6 is a fragmentary view of a portion of the carburetor of FIG. 5, showing the disk in a second rotational position.

After engine 24 is started and the temperature thereof increases through a warm-up period, bimetallic spring 106 rotates disk 104 to its second rotational position shown in FIGS. 4 and 6. Rotation of disk 104 moves slot 114 into a misligned position with respect to inlet 70 of priming passage 68, such that priming passage 68 is blocked by disk 104 and fuel is prevented from passing through priming passage 68 to throat 42 of carburetor 28, thereby terminating the priming function regardless of subsequent movement of plunger 96, such as during a warm engine re-start. Additionally, rotation of disk 104 to the position shown in FIGS. 4 and 6 moves valve element 116 away from outlet 66 of fuel supply passage 62 such that any remaining liquid fuel within priming chamber 60 may drain back into fuel bowl 40 as necessary. Therefore, the priming function of priming system 10 is disabled when engine 24 reaches a warm operating temperature.

Selective fitting of end 110 of bimetallic spring 106 between different adjacent pairs of adjustment pins 112 of disk 104 (or disk 130, discussed below) varies the connection point between bimetallic spring 106 and disk 104. By varying the connection point between bimetallic spring 106 and disk 104, the movement characteristics of disk 104 with respect to the temperature-controlled movement of bimetallic spring 106 may be adjusted. In this manner, the timed point during warm-up of engine 24 at which the priming function is disabled or reduced can be adjusted as needed, depending upon the particular operating characteristics of the engine with which carburetor 28 with priming system 10 is used, which operating characteristics may vary between engines of different types. Other techniques for adjusting the tension of spring 106 could be employed if desired. For example, end 110 of spring could be selectively inserted within one of a plurality of spaced apertures in disk 104.

Notably, if an operator actuates bail 26 of bail assembly 22 when engine 24 is in a warm condition, such as during a warm re-start of engine 24, movement of plunger 96 against return spring 98 forces any fuel within priming chamber 60 back through outlet 66 of fuel supply passage into fuel bowl 40. Concurrently, fuel supply passage 68 is blocked by disk 104 in a warm engine condition, as described above, such that any fuel within priming chamber 60 is prevented from being forced through priming passage 68 into throat 42 of carburetor 28. Therefore, flooding of engine 24 by supplying an overly rich fuel/air mixture is prevented when engine 24 is in a warm condition.

When engine 24 is shut down and bail 26 of bail assembly 22 is released, movement of plunger 96 outwardly of carburetor body 38 by return spring 98 increases the volume of priming chamber 60. Check valve 74 prevents air from entering priming chamber 60 from throat 42 through priming passage 68 and, because inlet 64 of fuel supply passage 62 is disposed below the level of fuel within fuel bowl 40, fuel is drawn through fuel supply passage 62 from fuel bowl 40 into priming chamber 60. After engine 24 cools, disk 104 is rotated by bimetallic spring back to its first position shown in FIG. 3, such that priming system 10 is effectively re-charged for a subsequent priming operation.

Referring now to FIGS. 1, 2, and 7–10, automatic priming system 120 in accordance with a second embodiment of the present invention is shown. Except as described below, the components of automatic priming system 120 are identical to those of automatic priming system 10 described above, and like reference numerals are used to designate such identical components therebetween.

Figure 9:
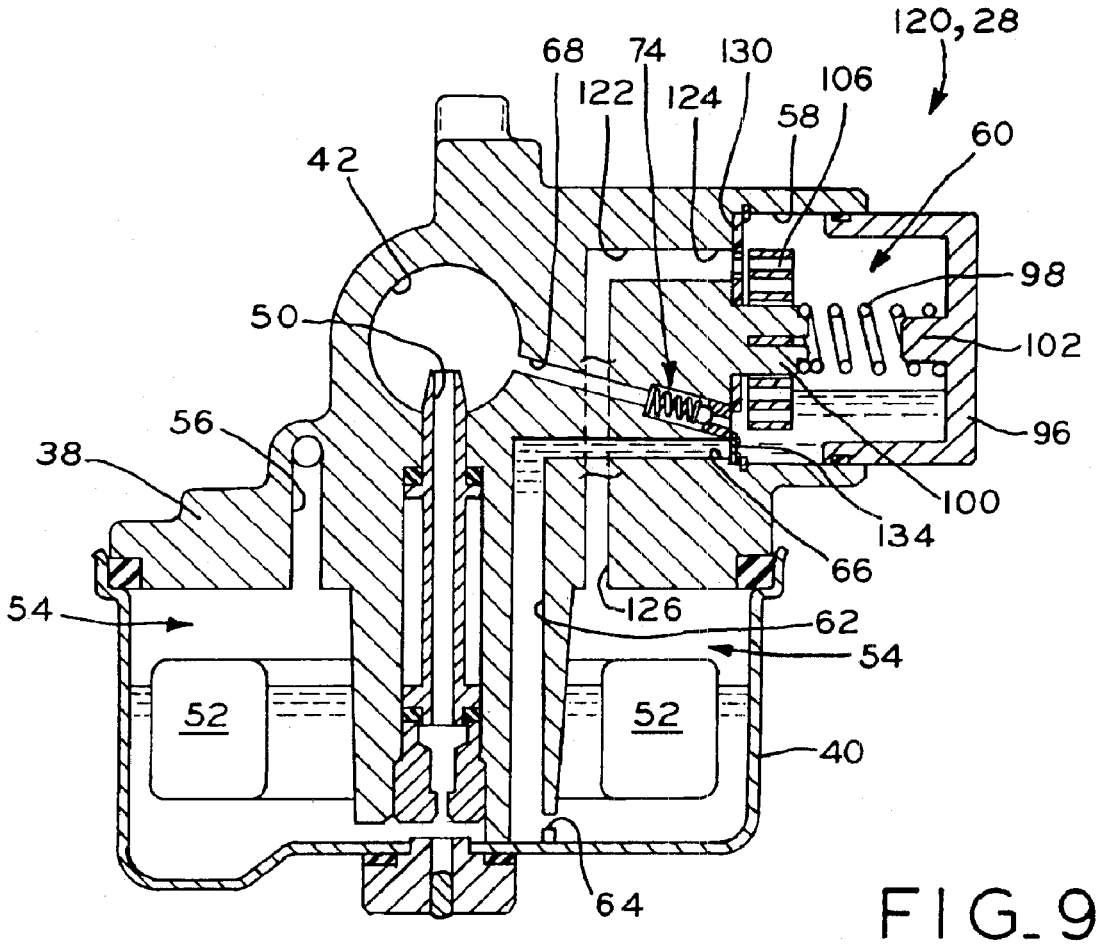
FIG. 9 is a vertical sectional view through the body of the carburetor of FIGS. 7 and 8, showing the disk in a first rotational position.

Referring to FIG. 9, carburetor 28 additionally includes vent passage 122 having first end 124 in fluid communication with priming chamber 60, and second end 126 in fluid communication with air space 54 of fuel bowl 40. As described above, air space 54 of fuel bowl 40 is vented to throat 42 of carburetor 28, and thence to the atmosphere, through internal vent passage 56.

Figure 7:
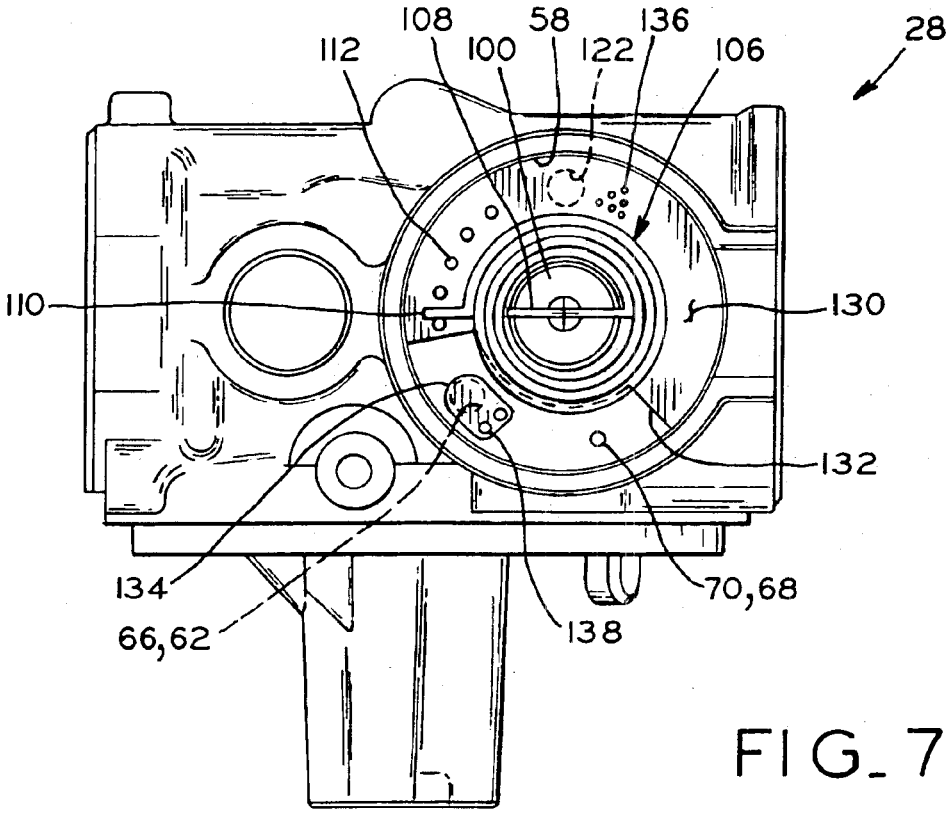
FIG. 7 is a first side elevational view of a portion of the carburetor, having a priming system according to a second embodiment, with the disk shown in a first rotational position corresponding to a cold engine temperature.
Figure 8:
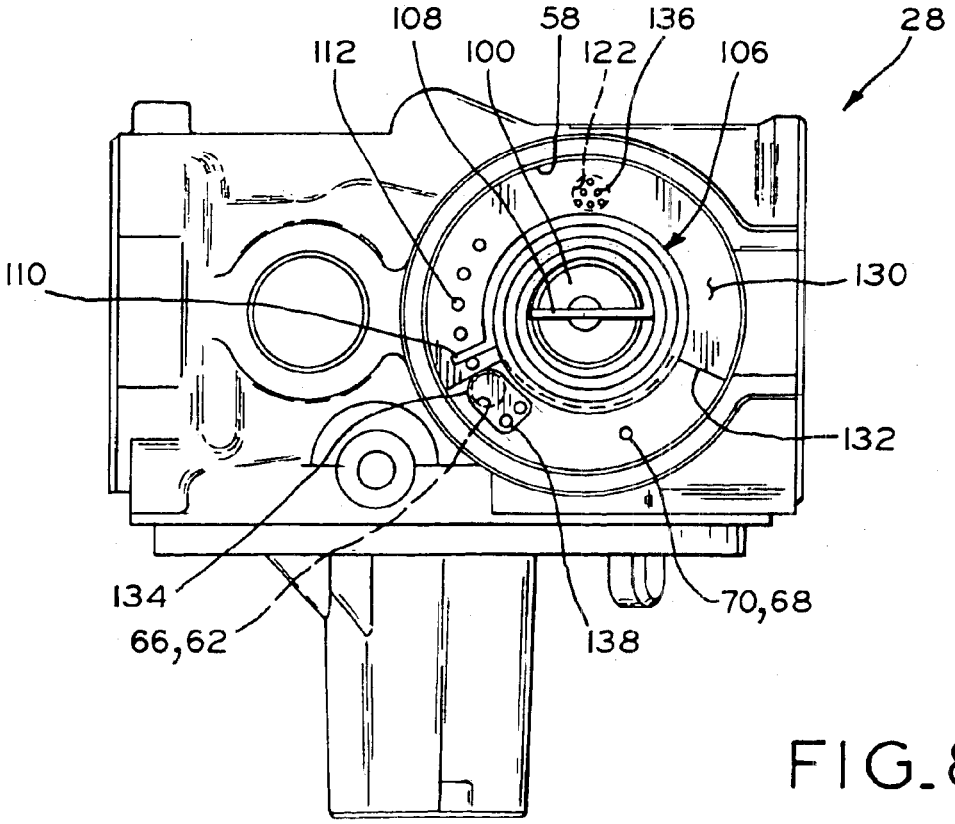
FIG. 8 is a second side elevational view of a portion of the carburetor of FIG. 7, showing the disk in a second rotational position corresponding to a warm engine temperature.

Referring to FIGS. 7 and 8, disk 130 is disposed within priming chamber 60, and is connected to bimetallic spring 106 in the same manner as disk 104 of the first embodiment described above. Disk 130 includes cutout portion 132 which is disposed generally over inlet 70 of priming passage 68 in both the first and second rotational positions of disk 130, as shown in FIGS. 7 and 8, respectively. In this manner, disk 130 never blocks inlet 70 of priming passage 68, such that priming chamber 60 is always in communication with throat 42 through priming passage 68.

Flap valve 134 is connected to carburetor body 38 in a suitable manner, such as by fasteners 138, and covers outlet 66 of fuel supply passage 62. Flap valve 134 may flex away from outlet 66 to allow passage of fuel from fuel supply passage 62 into priming chamber 60, but seats against outlet 66 to prevent passage of fuel from priming chamber 60 through fuel supply passage 62. In this manner, flap valve 134 functions similarly to valve element 116 of disk 104 of the first embodiment described above. However, in the second embodiment, flap valve 134 is not a part of disk 130, but rather is a separate element which is attached to carburetor body 38. Alternatively, in place of flap valve 134, a ball-and-spring or other type of check valve within fuel supply passage 62 may be used to allow passage of fuel from fuel supply passage 62 into priming chamber 60, but to prevent passage of fuel from priming chamber 60 through fuel supply passage 62.

Figure 10:
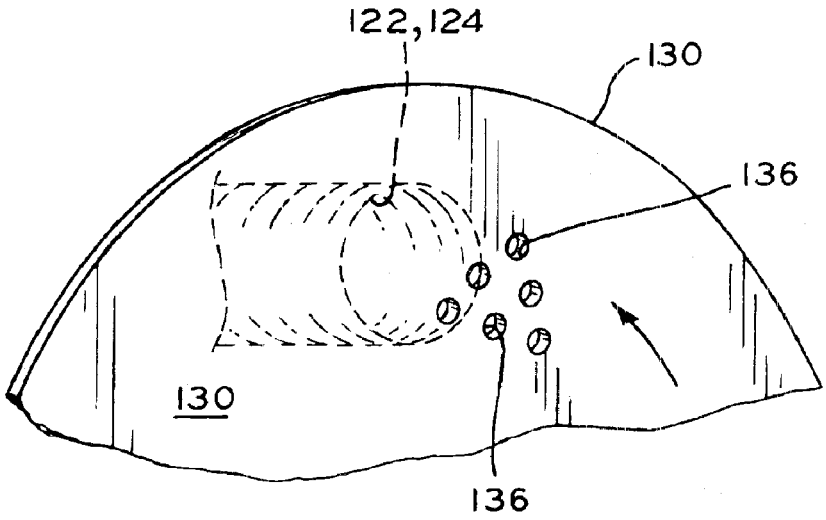
FIG. 10 is a fragmentary view of a portion of the disk of the carburetor of FIGS. 7–9, showing the vent holes moving into alignment with the vent passage upon rotation of the disk from the position of FIG. 7 to the position of FIG. 8.

With further reference to FIG. 10, disk 130 also includes a set of vent holes 136 which are arranged in a triangular or wedge-shaped pattern. In the first position of disk 130 shown in FIG. 7, vent holes 136 are not aligned with vent passage 122, such that disk 130 blocks communication between priming chamber 60 and air space 54 of fuel bowl 40 through vent passage 122. In the second position of disk 130, shown in FIG. 8, vent holes 136 are in alignment with vent passage 122, such that priming chamber 60 is in fluid communication with air space 54 of fuel bowl 40 through vent holes 136 and vent passage 122.

The operation of priming system 120 will now be described. When engine 24 is in a cold condition before starting, an initial quantity of fuel is disposed within priming chamber 60, as shown in FIG. 9, and plunger 96 is biased to its outward position by return spring 98. Additionally, bimetallic spring 106 is also in a cold state, and positions disk 130 in the first rotational position shown in FIG. 7, in which vent holes 136 of disk 130 are not aligned with vent passage 122, such that communication between priming chamber 60 and air space 54 of fuel bowl 40 is blocked by disk 130.

Referring to FIGS. 1 and 2, an operator primes the engine by actuating bail assembly 24, in which the operator manually moves bail 26 toward the upper portion of handle 20, thereby translating cable 36 and rotation cam member 82. Rotation of cam member 82 against the bias of return spring 88 rotates cam surface 94 thereof into contact with plunger 96, forcing plunger 96 inwardly toward carburetor body 38 against the bias of return spring 98. As plunger 96 is forced inwardly, the volume of priming chamber 60 is decreased, and a portion of the fuel within priming chamber 60 is forced through priming passage 68 and check valve 74 into throat 42 of carburetor 28, where the fuel is mixed with intake air drawn through throat 42 to form a rich air/mixture to aid in starting engine 24. Concurrently, fuel within priming chamber 60 is prevented from exiting priming chamber 60 through fuel supply passage 62, which is covered by flap valve 134 seated against outlet 66 of fuel supply passage 62.

After engine 24 starts, the operator will usually maintain bail 26 in the actuated position such as, for example, if bail assembly 22 is operatively connected to the ignition system of engine 24. Therefore, cam member 82 will maintain plunger 96 in a depressed condition during running of engine 24. Further, after engine 24 is initially started, a quantity of fuel, which is not initially forced through priming passage 68 into throat 42, remains within priming chamber 60 and is prevented from exiting priming chamber 60 due to the positioning of flap valve 134 over outlet 66 of fuel supply passage 62. The vacuum within throat 42 of carburetor 28 gradually draws this remaining quantity of fuel within priming chamber 60 through priming passage 68 and check valve 74 into throat 42 until the amount of fuel within priming chamber 60 is exhausted, or until disk 130 is shifted to its second rotational position, as described below. In this manner, priming chamber 60 not only supplies an initial amount of liquid fuel for engine priming upon starting of engine 24, but also supplies a further amount of priming fuel during an initial warm-up period after engine 24 starts for extended priming of engine 24.

After engine 24 is started and the temperature thereof increases through a warm up period, bimetallic spring 106 rotates disk 130 toward its second rotational position shown in FIG. 8. Referring to FIG. 10, during such rotation of disk 130, vent holes 136 are brought into alignment with vent passage 122 to permit an increasing amount of fluid communication between priming chamber 60 and air space 54 of fuel bowl 40 through vent passage 122.

If an operator actuates bail 26 of bail assembly 22 when engine 24 is in a warm condition, such as during a warm re-start of engine 24, movement of plunger 96 against return spring 98 forces some of the fuel within priming chamber 60 through priming passage 68 and into throat 42 to provide a supply of warm re-start priming fuel to engine 24. However, upon depression of plunger 96, air which is disposed within priming chamber 60 may pass through vent holes 136 and vent passage 122 into air space 54 of fuel bowl 40, and thence to the atmosphere through internal vent passage 56. In a similar manner, if priming chamber 60 is relatively full of fuel, fuel may also pass through vent holes 136 and vent passage 122 to drain back into fuel bowl 40.

The foregoing fluid communication between priming chamber 60 and fuel bowl 40 through vent passage 122 in the second rotational position of disk 130 allows for the escape of air from priming chamber 60 when plunger 96 is depressed. Thus, even through some priming fuel is forced through priming passage 68 into throat 42 when plunger 96 is depressed, the reduction in volume of priming chamber 60 upon depression of plunger 96 is mostly accommodated by venting of air within priming chamber 60 to the atmosphere, and, if priming chamber is relatively full of fuel, some of the fuel within priming chamber 60 is diverted back into fuel bowl 40. In this manner, a reduced amount of priming fuel is supplied to throat 42 through priming passage 68 during a warm re-start of engine 24. It has been found that supplying a reduced amount of warm re-start priming fuel to throat 42 of carburetor 28 aids in starting engine 24 even when engine 24 is warm. Also, because the amount of priming fuel which is supplied when engine 24 is warm is reduced with respect to the amount of priming fuel supplied when engine 24 is cold, flooding of engine 24 is avoided during warm re-starts.

Referring to FIG. 10, it may be seen that because vent holes 136 are disposed in a triangular or wedge-shaped arrangement, a greater number of vent holes 136 are progressively brought into alignment with vent passage 122 as disk 130 rotates. Thus, as disk 130 is rotated from its first rotational position (FIG. 7) to its second rotational position (FIG. 8), the above-described venting of air (or fuel) from priming chamber 60 through vent passage 122 is progressively increased, which in turn progressively decreases the amount of priming fuel which is supplied from priming chamber 60 to throat 42 through priming passage 68 in the event that plunger 96 is depressed. Other progressive venting arrangements for priming chamber 60 may be used as alternatives to vent holes 136. For example, a single wedge-shaped slot or hole may be formed within disk 130, or disk 130 may include a cutout portion of a variety of shapes which progressively aligns with vent passage 122.

Further, the positioning of disk 130 may be selected to provide a variable amount of initial priming to the engine during "cold" engine starts based upon the ambient temperature. For example, if the ambient temperature is low, such as 50° F. or below, bimetallic spring 106 may position disk 130 such that no vent holes 136 are in alignment with vent passage 122 such that a maximum amount of liquid fuel is supplied to throat 42 of carburetor 28 for priming during cold starts. Alternatively, if the ambient temperature is warm or hot, such as 50° F. or above or 80° F. or above, for example, bimetallic spring 106 may position disk 130 such that some of the vent holes 136 are in alignment with vent passage 122, thereby providing less than a maximum amount of liquid fuel to throat 42 of carburetor 28 for priming during cold starts.

When engine 24 is shut down and bail 26 of bail assembly 22 is released, movement of plunger 96 outwardly of carburetor body 38 by return spring 98 increases the volume of priming chamber 60. Check valve 74 prevents air from entering priming chamber 60 from throat 42 through priming passage 68, however, air is drawn into priming chamber 60 from air space 54 of fuel bowl 40 through vent passage 122 and vent holes 136. After engine 24 cools, disk 130 is rotated by bimetallic spring back to its first position shown in FIG. 7. Thereafter, actuation of bail assembly 22 and depression of plunger 96 forces air from priming chamber 60 through priming passage 68 into throat 42, and subsequent release of bail assembly 22 and outward movement of plunger 96 draws a new charge of fuel from fuel bowl 40 through fuel supply passage 62. At this point, priming system 120 is effectively re-charged for a subsequent priming and starting of engine 24.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A carburetor, comprising:

a carburetor body having a throat;

a movable primer element connected to said carburetor, said primer element and said carburetor defining a variable-volume priming chamber therebetween in which a quantity of liquid fuel is disposed, said priming chamber in fluid communication with said throat and further including a vent; and a thermally-responsive element disposed between said priming chamber and said vent, said thermally-responsive element moveable between a first position corresponding to cold temperatures in which said thermally-responsive element substantially blocks said vent, and a second position corresponding to warm temperatures in which said thermally-responsive element does not block said vent;

whereby when said thermally-responsive element is in said first position, movement of said primer element forces a first amount of said liquid fuel from said priming chamber into said throat, and when said thermally-responsive element is in said second position, movement of said primer element forces a reduced amount of said liquid fuel from said priming chamber into said throat.

2. The carburetor of claim 1, wherein said primer element comprises a piston member slidably connected to said carburetor body.

3. The carburetor of claim 2, further comprising a return spring connected between said carburetor body and said piston member, said return spring biasing said piston member away from said carburetor body.

4. The carburetor of claim 1, wherein said thermally-responsive element comprises:

a movable member; and a bimetallic element connected between said carburetor body and said movable member, said bimetallic element positioning said movable member in said first position at cold temperatures and positioning said movable member in said second position at warm temperatures.

5. The carburetor of claim 4, wherein said bimetallic element comprises a bimetallic spring.

6. The carburetor of claim 5, wherein said bimetallic spring is adjustably coupled to said movable member, whereby the tension of said bimetallic spring may be adjusted.

7. The carburetor of claim 4, wherein said movable member comprises a rotatable disk disposed within said priming chamber.

8. The carburetor of claim 1, wherein said vent comprises a passage fluidly communicating said priming chamber with a fuel bowl of said carburetor, and said thermally-responsive element includes at least one opening therein which is aligned with said passage in said second position.

9. The carburetor of claim 1, further comprising a passage fluidly communicating said priming chamber with said throat, said passage including a check valve therein which allows passage of fluid from said priming chamber to said throat but prevents passage of fluid from said throat to said priming chamber.

10. The carburetor of claim 1, wherein said carburetor body includes a fuel bowl in fluid communication with said priming chamber, and a valve element between said fuel bowl and said priming chamber, said valve element allowing passage of fuel from said fuel bowl into said priming chamber but preventing passage of fuel from said priming chamber to said fuel bowl.

11. The carburetor of claim 10, wherein said valve element comprises a flap valve disposed within said priming chamber.

12. A carburetor, comprising:

a carburetor body having a throat;

a movable primer element connected to said carburetor body and defining a variable volume priming chamber therebetween in which a quantity of liquid fuel is disposed, said priming chamber in fluid communication with said throat; and thermally-responsive means disposed within said priming chamber for reducing the amount of said liquid fuel which is forced from said priming chamber into said throat upon movement of said primer element as the temperature within said priming chamber increases.

13. The carburetor of claim 12, wherein said primer element comprises a piston member slidably connected to said carburetor body.

14. The carburetor of claim 12, wherein said priming chamber further comprises a vent, said thermally-responsive means disposed between said priming chamber and said vent.

15. The carburetor of claim 12, wherein said thermally-responsive means comprises:

a vent in fluid communication with said priming chamber;

a movable member; and a bimetallic element connected between said movable member and said carburetor, said bimetallic element positioning said movable member in a first position at cold temperatures to block said vent such that a greater amount of fuel is forced from said priming chamber into said throat and a second position at warm temperatures in which said movable member does not block said vent such that a lesser amount of fuel is forced from said priming chamber into said throat.

16. The carburetor of claim 12, further comprising a remotely actuable primer actuator connected to said primer element.

17. The carburetor of claim 16, wherein said primer actuator comprises:

an cam member rotatably mounted to said carburetor and having a cam surface disposed proximate said primer element, whereby rotation of said cam member engages said cam surface with said primer element to depress said primer element.

18. An internal combustion engine, comprising:

an engine housing;

a carburetor attached to said engine housing, said carburetor having a throat;

a movable primer element connected to said carburetor, said primer element and said carburetor defining a variable-volume priming chamber therebetween in which a quantity of liquid fuel is disposed, said priming chamber in fluid communication with said throat and further including a vent; and a thermally-responsive element disposed between said priming chamber and said vent, said thermally-responsive element moveable between a first position corresponding to cold engine temperatures in which said thermally-responsive element blocks said vent, and a second position corresponding to warm engine temperatures in which said thermally-responsive element does not block said vent;

whereby when said thermally-responsive element is in said first position, movement of said primer element forces a first amount of said liquid fuel from said priming chamber into said throat, and when said thermally-responsive element is in said second position, movement of said primer element forces a reduced amount of said liquid fuel from said priming chamber into said throat.

19. The engine of claim 18, wherein said primer element comprises a piston member slidably connected to said carburetor.

20. The engine of claim 18, further comprising:

an operator-controlled bail assembly;

a cam member rotatably mounted to said carburetor and having a cam surface disposed proximate said primer element; and linkage connecting said bail assembly and said cam member, wherein actuation of said bail assembly translates said linkage to rotate said cam member, engaging said cam surface with said primer element to depress said primer element.

21. The engine of claim 18, wherein said quantity of liquid fuel disposed within said priming chamber is greater than said first amount which is injected into said throat such that, after the engine is started, at least a further portion of said quantity of fuel is drawn by said engine from said priming chamber into said throat to provide an enriched fuel/air mixture.

22. A carburetor, comprising:

a carburetor body having a throat;

a primer element moveably connected to said carburetor, said primer element and said carburetor defining a variable-volume priming chamber therebetween in fluid communication with said throat, in which a quantity of liquid fuel is disposed;

a primer quantity regulating element movable between a full prime position corresponding to cold engine temperatures in which a first amount of said liquid fuel is forced from said priming chamber into said throat upon movement of said primer element, and a reduced prime position corresponding to warm engine temperatures in which a reduced amount of said liquid fuel is forced from said priming chamber into said throat upon movement of said primer element;

said regulating element driven by a thermally-responsive element mechanically connected to said regulating element, said thermally-responsive element responsive to engine temperature changes, said thermally-responsive element adjustably connected to said primer regulating element, whereby movement characteristics of said primer regulating element may be varied.

23. The carburetor of claim 22, wherein said thermally-responsive element comprises a bimetallic spring, said bimetallic spring adjustably connected to said regulating element to vary the tension of said bimetallic spring.

24. The carburetor of claim 22, wherein said prime quantity regulating element is movable between a first position in which flow of said liquid fuel from said priming chamber into said throat is allowed upon movement of said primer element, and a second position in which flow of said liquid fuel from said priming chamber into said throat is disabled.

25. A method of operating an internal combustion engine having a carburetor, comprising the steps of:

depressing a primer element to reduce the volume of a priming chamber in which a quantity of liquid fuel is disposed;

forcing at least a portion of the liquid fuel from the priming chamber into a throat of the carburetor to prime the carburetor;

starting the engine; and automatically opening a vent in the priming chamber when the engine reaches a warm operating temperature, whereby a reduced portion of liquid fuel is forced from the priming chamber into the throat of the carburetor upon any subsequent depression of the primer element.

26. The method of claim 25, wherein said depressing step further comprises actuating an implement handle mounted bail assembly associated with the engine to depress said primer actuator.

* * * * *